US005348176A

United States Patent [19]

Yurgevich et al.

[11] Patent Number: 5,348,176

[45] Date of Patent: Sep. 20, 1994

[54] HIGH-CUBE TOP LIFT CARGO CARRIER STRUCTURE

[75] Inventors: Howard J. Yurgevich; Thomas J. Rosby, both of Monticello, Ind.

[73] Assignee: Rosby Corporation, Monon, Ind.

[21] Appl. No.: 127,307

[22] Filed: Sep. 27, 1993

Related U.S. Application Data

[63] Continuation-in-part of Ser. No. 792,950, Nov. 15, 1991, and a continuation-in-part of Ser. No. 17,786, Feb. 16, 1993, Pat. No. 5,248,051, which is a continuation of Ser. No. 839,811, Feb. 21, 1992, Pat. No. 5,205,428.

[51] Int. Cl.[5] ..... B65D 88/00

[52] U.S. Cl. ..... 220/1.5; 24/287

[58] Field of Search ..... 220/1.5; 24/287; 410/54, 77, 84; 414/141.7

[56] References Cited

U.S. PATENT DOCUMENTS

| | | | |
|---|---|---|---|
| 3,404,444 | 10/1968 | Isbrandtsen | 24/287 X |
| 4,049,149 | 9/1977 | Durenec | 24/287 X |
| 4,521,941 | 6/1985 | Gerhard | 220/1.5 X |
| 4,591,307 | 5/1986 | Clive-Smith | 24/287 |
| 4,844,672 | 7/1989 | Yurgevich | 220/1.5 X |
| 5,083,673 | 1/1992 | Fossey | 220/1.5 |

*Primary Examiner*—Steven M. Pollard
*Attorney, Agent, or Firm*—Locke Reynolds

[57] ABSTRACT

A cargo carrier liftable by, a lift element of a vertical mover includes a floor, a roof, a pair of parallel side walls, and first and second end walls, at least one of the side walls and end walls including a opening to permit the entry and exit of cargo. A plurality of low profile floor supports extend between the side walls to increase container capacity without increasing exterior dimensions of the container. A plurality of lift pockets are fixed to the side walls adjacent the roof, each lift pocket including a back plate and a guide plate attached to lie in parallel contiguous relationship to the side wall and in spaced apart parallel relationship to the back plate to define a cavity therebetween. The guide plate includes an aperture therethrough to allow acceptance of the lift element, the guide plate aperture including opposing edges having upwardly converging linear segments for guiding the lift element into engagement with the lift pocket, the upper edge of the aperture defined by an arcuate segment intersecting the upwardly converging linear segments. The back plate lower portion is outwardly inclined for encouraging disengagement of the lift element from the guide plate aperture upon downward movement of the lift element with respect to the cargo carrier.

20 Claims, 7 Drawing Sheets

HIGH-CUBE TOP LIFT CARGO CARRIER STRUCTURE

CROSS-REFERENCE TO RELATED APPLICATIONS

This application is a continuation-in-part of co-pending application Ser. No. 07/792,950 filed Nov. 15, 1991, and co-pending application Ser. No. 08/017,786 filed Feb. 16, 1993, now U.S. Pat. No. 5,248,051, which is a continuation of application Ser. No. 07/839,811 filed Feb. 21, 1992, now U.S. Pat. No. 5,205,428.

BACKGROUND OF THE INVENTION

This invention relates generally to cargo carriers such as trailers, intermodal containers, and the like employed in the transportation of goods. The invention particularly relates to cargo carriers made principally or wholly from aluminum alloy extrusions and plates.

In recent years, there has been growing interest in developing intermodal cargo containers suitable for transportation by truck, rail, or ship. With the dramatic increase in import and export trade experienced worldwide, the demand for such cargo containers has steadily increased. There has also been a steady demand that the intermodal containers, as well as trailers, be designed so as to have maximum volume capacity yet have outside dimensions within the laws and regulations applied to trailers and containers when they are being transported over the road by truck.

Many cargo carriers suitable for multi-mode transport of cargo have recognized standard dimensions, structural features that minimize handling problems, and allow for stacking of containers. However, there exist a number of different and changeable standards. For example, in recent years, due to the relaxation of the permitted width dimension allowed on over-the-road truck trailers, some attention has been directed to the construction of increased width containers to increase container capacity as disclosed in U.S. Pat. No. 4,844,672, and increased width trailers as disclosed in U.S. Pat. No. 4,904,017.

Another possible way for increasing cargo carrier capacity while retaining the outside maximum dimensions standardized by the industry regulations is by increasing the vertical height dimension of the interior of the cargo container. For example, the vertical height of conventional I-beam floor supports, as well as the thickness of wood flooring attached to the floor supports, can be reduced to increase the capacity of the cargo carrier. However, the structural requirements for supporting a defined load within cargo carriers does not permit substantial decrease in floor thickness using conventional materials or structures.

Inasmuch as cargo carriers, particularly intermodal containers, can on occasion be exposed to sea transport, it is important that any dissimilarity in metals be avoided in order to reduce any galvanic degradation of the cargo carrier. As is part of the desire to maximize the volume of such cargo carriers, there is also a desire to maximize the vertical inside height by providing a floor structure which is as thin as possible while time retaining the necessary strength required for the long duty life typically experienced by such cargo carriers.

These factors have led the inventors to focus attention on adopting a new floor structure, preferably made entirely of aluminum alloy, which would have sufficient strength and durability, and could be used on all types of cargo carriers including trailers and intermodal containers. A further object of the new floor structure is to provide a design which is suitable for use in cargo carriers employing a wide variety of structural elements taken from containers other than of aluminum alloy plate construction. Of particular interest was a desire to arrive at a construction which would permit easily repeatable assembly of cargo carriers even under close tolerance restrictions.

With the dramatic increase in import and export trade experienced worldwide, the demand has also steadily increased for cargo carriers, including both trailers and containers, having common features which would permit top handling of the cargo carrier by a common means. There has also been a steady demand that the cargo carriers be designed so as to have lift pockets which only minimally intrude into the interior volume of the cargo carriers.

These factors have led the inventors to focus attention on adopting a new lift pocket structure which would have sufficient strength and durability, and could be used on all types of cargo carriers including trailers and intermodal containers for simple engagement with pin, or pin and shoe, lift mechanisms. A further object of the new lift pocket structure is to provide a design which is suitable for use in cargo carriers employing a wide variety of structural elements taken from containers and trailers having other than aluminum alloy plate construction.

Accordingly, an object of the present invention is to provide a cargo carrier having substantially increased usable internal space through utilization of a novel floor structure having minimum vertical dimensions while retaining the necessary strength and providing the necessary lift pocket structure to permit stacking of the cargo carrier and contents in the conventional manner. Another object of the present invention is the use of such a novel floor structure together with a novel lift pocket structure in a cargo carrier having other volume maximizing features to achieve a very large cubic volume capacitor.

SUMMARY OF THE INVENTION

A cargo carrier in accordance with the present invention encloses cargo within a compartment defined generally by a floor, a roof, a pair of parallel side walls, and first and second end walls. At lease one of the side walls and end walls includes an opening to permit the entry and exit of cargo from the enclosed space. The interior of the cargo container is maximized in the vertical direction by incorporating a floor comprising a plurality of low profile floor supports extending between the side walls. The plurality of floor supports are generally substantially uniformly distributed throughout the entire length of the floor.

In the preferred embodiment, the side walls comprise a plurality of aluminum alloy plates assembled side by side. A plurality of aluminum stiffener panels overlie and join adjacent sides of the aluminum alloy plates sealing the enclosed compartment against the outside environment. The side wall construction and joining stiffener plates is similar to that construction discussed in U.S. Pat. Nos. 4,904,017, 4,685,721, 5,066,066 and 5,122,099.

A cargo carrier in accordance with the present invention also includes a plurality of box-like coupling means for coupling the cargo carrier in stacked relation to other cargo carriers of similar construction. Preferably, such box-like , coupling means are constructed of high-strength cast aluminum alloy when used in an all-aluminum construction in accordance with the present invention. Of course, suitable cast steel or other metal can be employed in the appropriate circumstance. The box-like coupling means are generally employed with stacking frames. The box-like coupling means are generally arranged on both the top and bottom of a container, but can be included only on the top of a trailer. In one embodiment intended merely for stacking on top of other containers, the box-like coupling means are only provided at the floor level of the container and no stacking frames are provided. It will be appreciated that top-handling of such a container is to be discouraged, or alternative means must be provided to permit such top-handling.

In accordance with the present invention a cargo carrier can include lift pockets at the juncture of the top and side wall, and preferably at the top of an intermediate frame post, to facilitate various lift attachment devices. The lift pockets can be positioned bilaterally symmetric with respect to each other, with two lift pockets on one side wall being matched by correspondingly positioned pockets on the opposite side wall. In addition, pairs of lift pockets are positioned equivalent distances from the center of mass of the cargo carrier to reduce problems with differential forces applied to lifting mechanisms engaged into the lift pockets to move the cargo carrier.

The top lift pockets are preferably formed by the combination of a back plate and a guide plate formed to define a guide plate aperture. The guide plate aperture preferably comprises upper edge defined by an arcuate or a semicircular segment. The ends of the arcuate or semicircular segment join to an opposing pair of diverging edge segments spreading apart in a downward direction, the diverging segments being configured to guide an upwardly moving lift element into engagement with the lift pocket. The lift pocket is dimensioned to accommodate insertion of a lift bolt or pin which can be connected to a lift shoe. The lift bolt can be connected to a crane, spreader, mover or some other device capable of lifting the container. Various positions of lift pockets are contemplated, as well as differing numbers of lift pockets, as needed.

Of particular interest is the floor which is designed to maximize the interior dimension of the cargo carrier. In a first embodiment the floor comprises a pair of spaced parallel C-shaped channel members situated so as to have the C's opening toward each other. A plurality of floor panels are situated contiguously to each other in a common plane defined by the pair of C-shaped channel members. Each of the floor panels comprises a unitary member, preferably constructed of a high-strength aluminum alloy, the floor panel including a pattern of webs and flanges defining parallel ducts and channels. The ends of the ducts and channels are received in the C-shaped channel members with the ducts and channels arranged perpendicularly to the bight of the C-shaped channel members. Fastening means are provided for joining the plurality of floor panels to the C-shaped members preferably by passing through contiguous portions of the webs and flanges of the floor panels and one or more of the legs of the C-shaped channel members.

In a second embodiment the floor comprises a plurality of spaced apart floor supports with each floor support consisting essentially of a pair of uniformly spaced apart vertical members having upper and lower ends, and a horizontal member joining the lower ends of the two vertical members to form in cross-section a U-shape. Reinforcing means in the form of bars or thickened portions are provided for reinforcing the horizontal member joining the lower ends and forming the bight of the U-shape. Flanges extend outwardly from the tops of each of the vertical members. The length of the vertical members is defined to be less than the horizontal distance between the vertical members of each support element, permitting the floor to occupy a minimum vertical space and increasing the internal capacity of the cargo container as compared to cargo containers having floors supported by conventional I-beams. It will be appreciated that it may also be possible to achieve a similar effect by fabricating H-beams having dimensions suitable for use as floor supports in a minimum vertical space floor as previously disclosed.

The plurality of floor panels, and floor supports previously discussed generally form a first layer or subfloor over which is added a second layer comprising a plurality of longitudinally-extending elements situated parallel to side walls and fixed to the plurality of floor panels or floor supports. While the longitudinally-extending elements forming the upper second layer of the floor can be wood flooring strips or other similar material, an all-aluminum construction can be achieved by employing extruded aluminum members. Typically, these strips are attached by screws, bolts, or other conventional fasteners to the uppermost surfaces of the first layer. The second layer can be added over the first layer either before or after attachment of the base rails of the parallel side walls.

The floor construction of the present invention leads to a reliable assembly which, if desired, permits preconstruction of the floor and side walls separate from each other followed by the co-joining of the side walls to the already-constructed single layer floor to be followed by the addition of the floor second layer, a roof structure, and the like to complete the container. Cargo carriers in accordance with the present invention achieve a desired volume capacity by minimizing the floor thickness while retaining the necessary floor strength. When an all-aluminum construction is employed, the container is well adapted for long life inasmuch as galvanic degradation of the container is avoided. Further, the residual value found in an all-aluminum container at the end of its duty life is substantial inasmuch as the container as a whole is easily recycled.

One feature of the present invention is the use of a low profile floor structure as described. The vertical dimension of such floor structure is minimized to permit a maximizing of the internal volume capacity of the cargo carrier enclosed compartment. Another feature of the present invention is the use of lift pockets which include an arcuate or semicircular segment joined to an opposing pair of diverging edge segments spreading apart in a downward direction. The diverging segments advantageously guide an upwardly moving lift element into engagement with the lift pocket.

Other feature and advantages of the present invention become apparent to those skilled in the art upon consideration of the following description of the preferred embodiments exemplifying the best mode of carrying out the invention as presently perceived. The detailed description particularly refers to the accompanying drawings.

DESCRIPTION OF THE PREFERRED EMBODIMENTS

Figure 1:
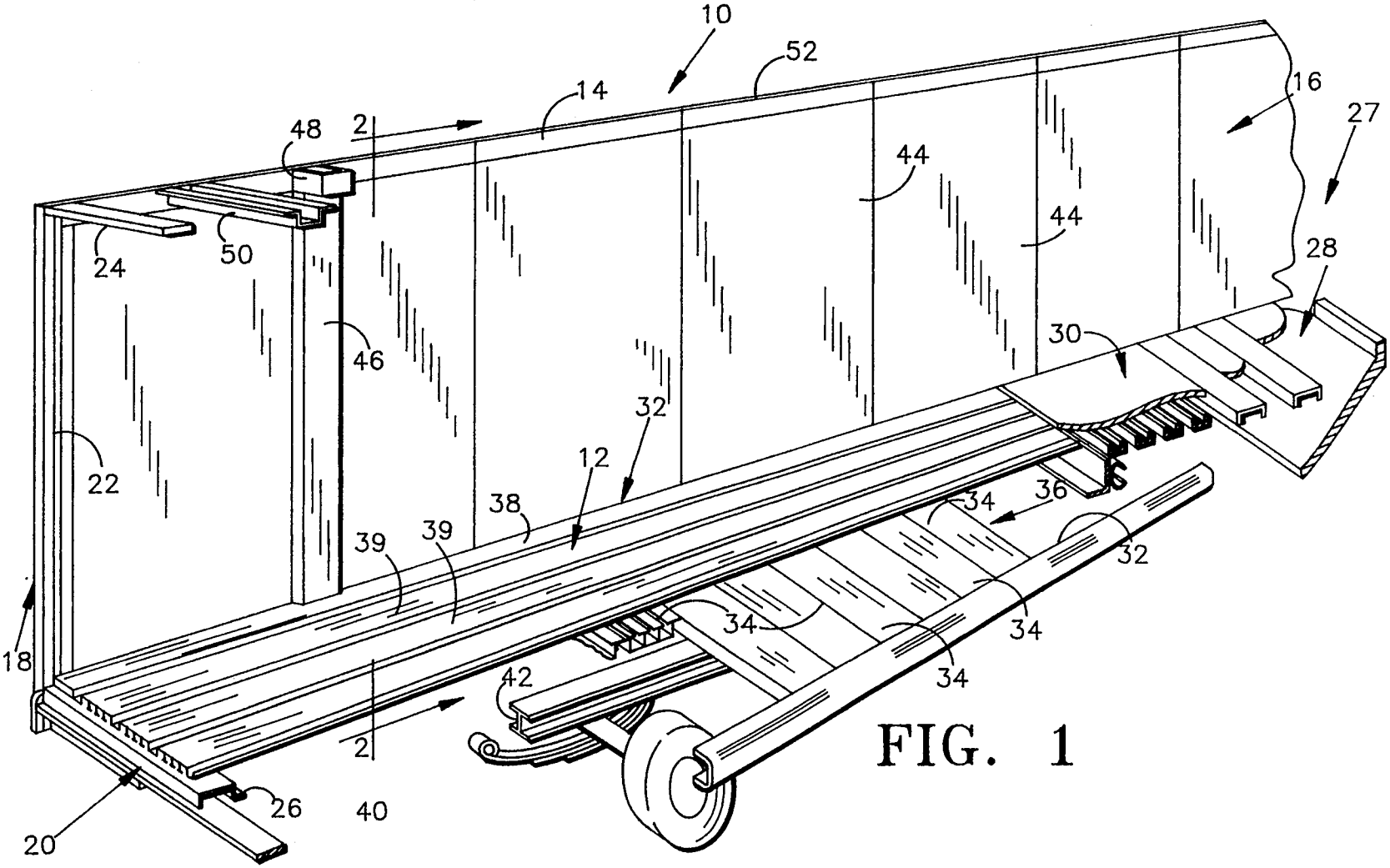
FIG. 1 is a perspective view partially broken away of a cargo carrier in accordance with the present invention.

A cargo carrier 10 in accordance with the present invention is defined generally by a floor 12, a roof 14, a pair of parallel side walls 16 and end walls 18, at least one of which includes an opening 20 to permit the entry and exit of cargo. Suitable door structure (not shown) is of course provided to close the opening 20. The opening 20 is defined generally by the edges 22 of the side wall 16, a header 24, and a sill 26 underlying the threshold.

The floor 12 extends from the rear sill 26 through the entire length of the cargo carrier 10 and can be of generally uniform construction of the type hereinafter discussed. Alternatively, a forward portion of the container can include strengthening features in a coupler area 28 and over a support dolly area 30, which can include a gooseneck tunnel, depending upon the use to which the cargo carrier will be put.

In a first embodiment, the floor 12 is generally composed of a pair of spaced parallel C-shaped channel members 32 which open toward each other in confronting relationship, of which only one is shown in FIG. 1. A plurality of panels 34, shown only in generally in FIG. 1, and shown in greater detail in FIG. 3, extend from side to side of the trailer. Each of the panels 34 comprises a unitary member including a pattern of webs and flanges shown in somewhat more detail as panel 34' in FIG. 1, it being understood that all the panels 34 are of similar construction with the webs and flanges of the panels forming a series of parallel ducts and channels the ends of which are received in the C-shaped channel members 32. The plurality of panels 34 taken together form a first layer 36 of the floor 12, namely, the layer 36 lying in the plane of the C-shaped channel members 32.

The first layer 36 supports a second layer 38 which generally comprises a plurality of elements 39 which extend longitudinally along the length of the cargo carrier. In the preferred embodiment, the longitudinal elements 38 consist essentially of extruded aluminum members, but can also consist of wood flooring strips or other flooring elements best suited for the intended purpose of the cargo carrier. The first layer 36 is intended to have sufficient integrity and strength as to form a base upon which the container 10 can be supported by an appropriate running gear 40, including beams 42 which can contact and be coupled directly to a lower surface of the panels 34. The vertical thickness of the layers 36 and 38 are minimized to maximize the cubic capacity of the cargo carrier.

Figure 12:
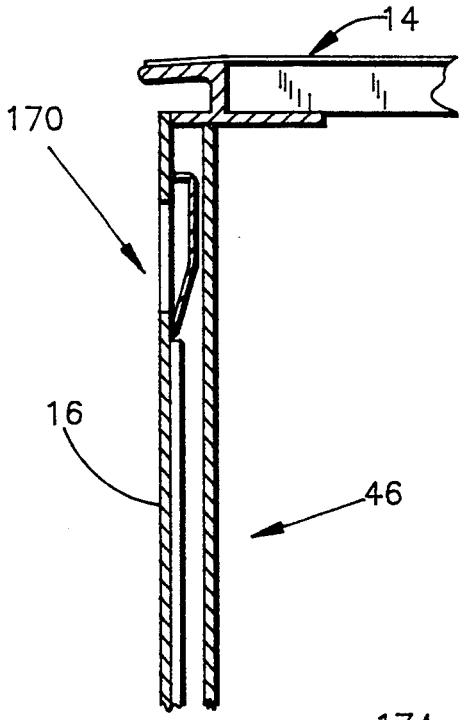
FIG. 12 is an enlarged view from the left side of FIG. 11 of one of four identically configured top lift pockets designed to allow engagement of the cargo carrier for lifting or movement.
Figure 12:
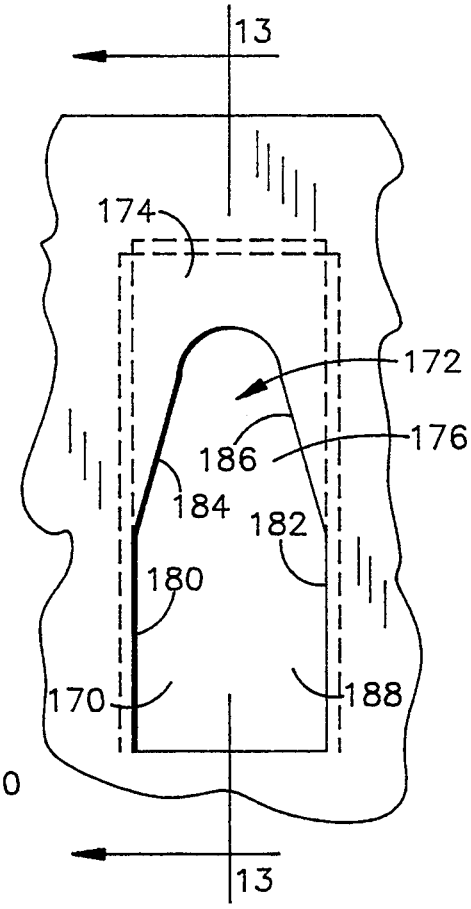
Figure 13:
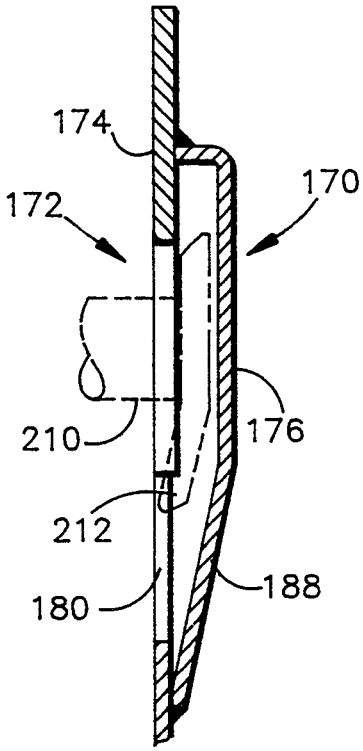
FIG. 13 is a cross-sectional view of the lift pocket such as shown in FIG. 12, with a lift shoe and lift bolt for engaging the top lift pocket schematically represented by the dotted outline.
Figure 11:
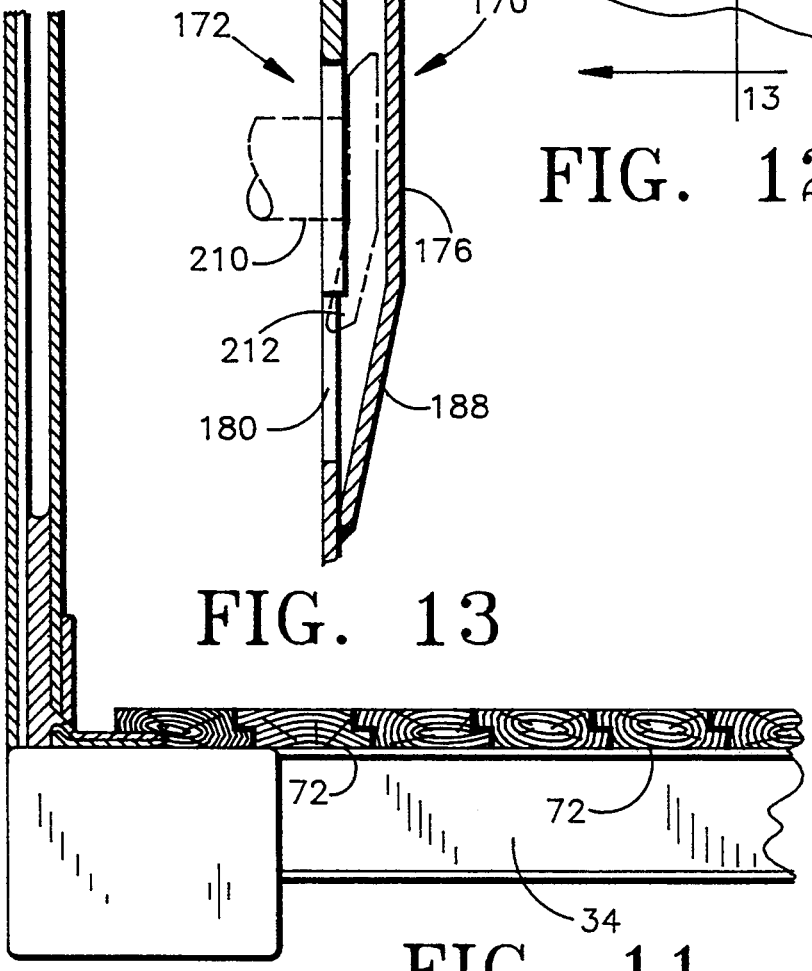
FIG. 11 is a sectional view similar to FIG. 2 taken through an intermediate frame post of a cargo carrier of the present invention.

The side wall 16 is illustrated to comprise a plurality of vertically-oriented panels or plates 44 which can be of various construction, but are preferably made of aluminum alloy plate of the type generally described in U.S. Pat. Nos. 4,685,721 and 4,904,017. The side wall 16 is shown in FIG. 1 to include a frame post 46 which can have at its upper end a box-like coupling member 48 of the type generally employed with intermodal freight containers such as that shown in U.S. Pat. No. 3,085,707. Preferably, lift pockets as disclosed in greater detail in FIGS. 11 through 13 are provided, alternatively or additionally, at the top of the frame post 46.

Figure 2:
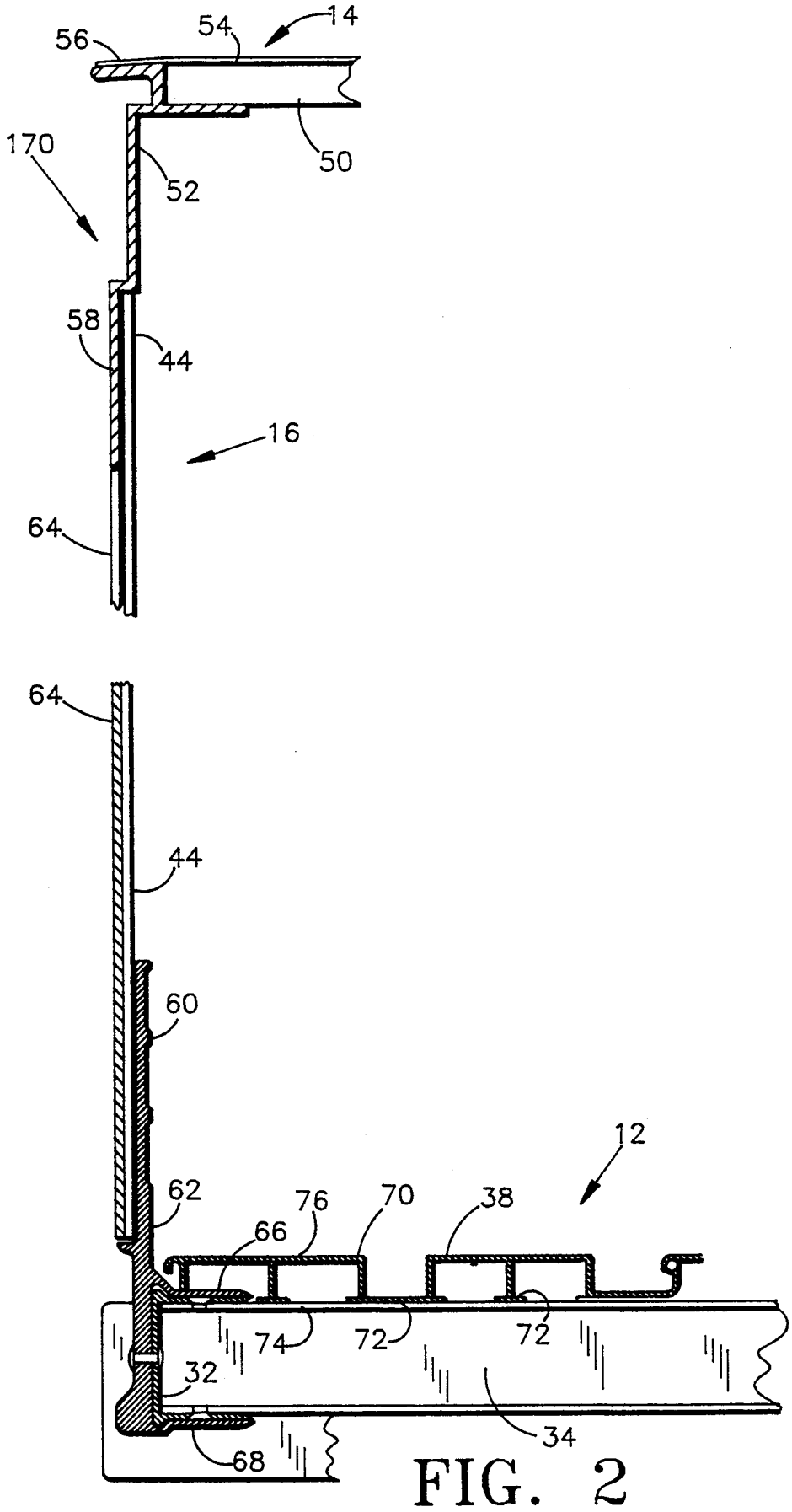
FIG. 2 is a sectional view of a side wall of the cargo carrier shown in FIG. 1 taken along lines 2—2.

The roof 14 is constructed from a series of roof bows 50 extending laterally between the tops of the two parallel side walls 16. As shown in FIG. 2, the ends of the roof bows are generally supported by a top rail 52 defining the upper margin of the side wall 16. An appropriate skin or cover 54 is stretched over the roof bows 50 and secured to an upper margin 56 of the top rail 52 by appropriate fastening means. The top rail 52 can be seen in FIG. 2 to include a lower portion 58 which extends downward over the outside of an upper margin of panels 44. The panels 44 extend downward over the outside of an upper portion 60 of base rail 62. The panels 44 are joined together by joining stiffening members 64 in the usual manner for aluminum alloy plate trailers.

In FIG. 2 it will be noted that the base rail 62 includes a lower portion having a pair of inwardly-directed flanges 66 and 68. The flanges 66 and 68 act to capture the separate C-shaped member 32 which holds the ends of panels 34. As shown in FIG. 2, the upper layer 38 of the floor 12 comprises a plurality of aluminum extrusion members 70 which can be of any of several suitable designs. In addition to the design illustrated, other designs which might be employed are disclosed by U.S. Pat. Nos. 4,266,381, and 4,631,891.

The aluminum extrusion members 70 forming the upper layer 38 have a lower surface defined by a series of flanges 72 which are supported by the upper surface 74 of panels 34. The upper surface 76 of aluminum extrusion members 70 form the supporting surface for the goods to be carried by the cargo carrier 10. It will be seen from the detailed view of FIG. 3 that the flanges 72 and 76 together with webs 78 define a series of channels most of which open downwardly to confront the underlying lower layer 36 of the floor but some of which open upwardly.

Figure 3:
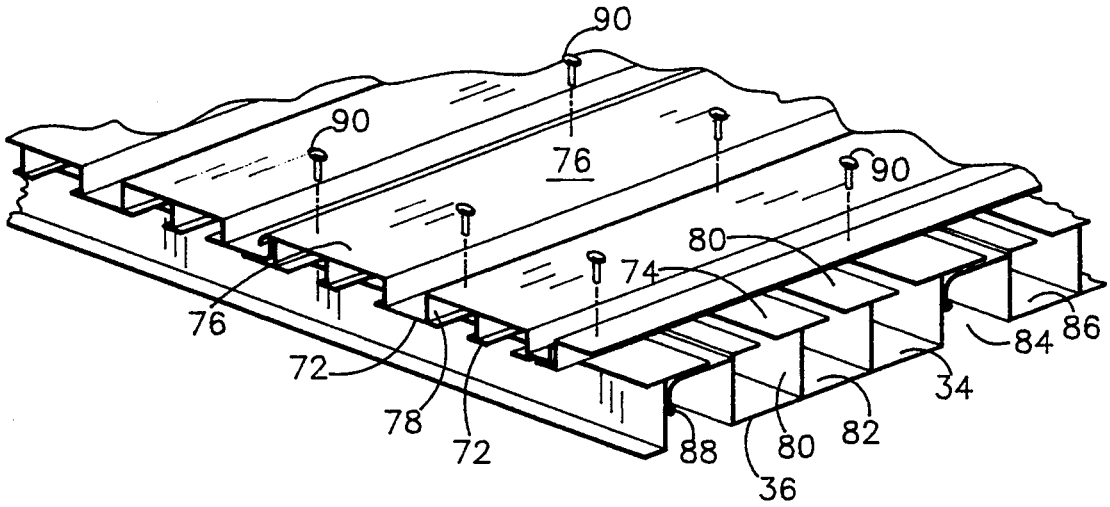
FIG. 3 is a detailed perspective view of the two layers forming the cargo carrier floor shown in FIG. 2.

The lower layer 36 of panels 34 is also seen in FIG. 3 to comprise a plurality of webs 80 and flanges 82 and 83 which again define ducts 84 and channels 86. Each of the panels 34 is coupled to the adjacent panel 34 by a coupling means 88 running the length of each of the panels 34 for coupling contiguous panels together. Appropriate fastening means 90 are employed to fasten the upper floor portion 38 to the lower floor portion 36.

Figure 4:
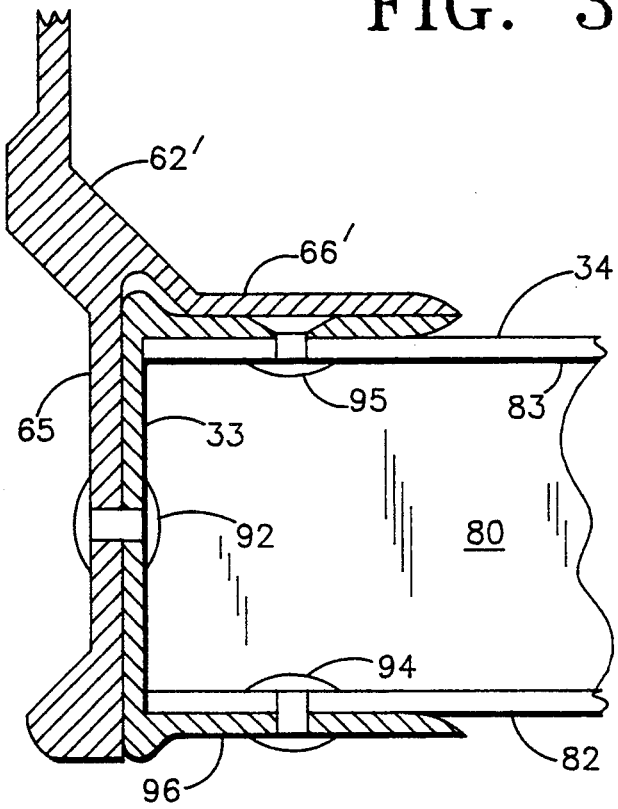
FIG. 4 is a detailed sectional view of the joining portion between the floor shown in FIG. 2 and the base of the side wall.

FIG. 4 shows the enlarged view of a base rail 62' which includes an upper flange 66' which is directed inwardly toward the center of the cargo carrier. The lower portion 65 of the base rail 62' is coupled to the bight 33 of C-shaped channel 32 by fastener 92. Additional fasteners 94 attach the lower and upper legs 96 and 97 of the C-shaped channel 32 to a lower and upper flange 82 and 83 of panel 34, respectively. It will be appreciated that the first layer or subfloor 36 comprising the plurality of panels 34 and C-shaped members 32 can be pre-assembled as a unit. Thereafter the side walls 16 can be positioned adjacent the longitudinal edged of the subfloor. The C-shaped channel 32 is then attached to the lower portion 65 of base rail 62 by means of a plurality of fasteners 92 passing through the bight 33 of C-shaped channel 32.

Figure 5:
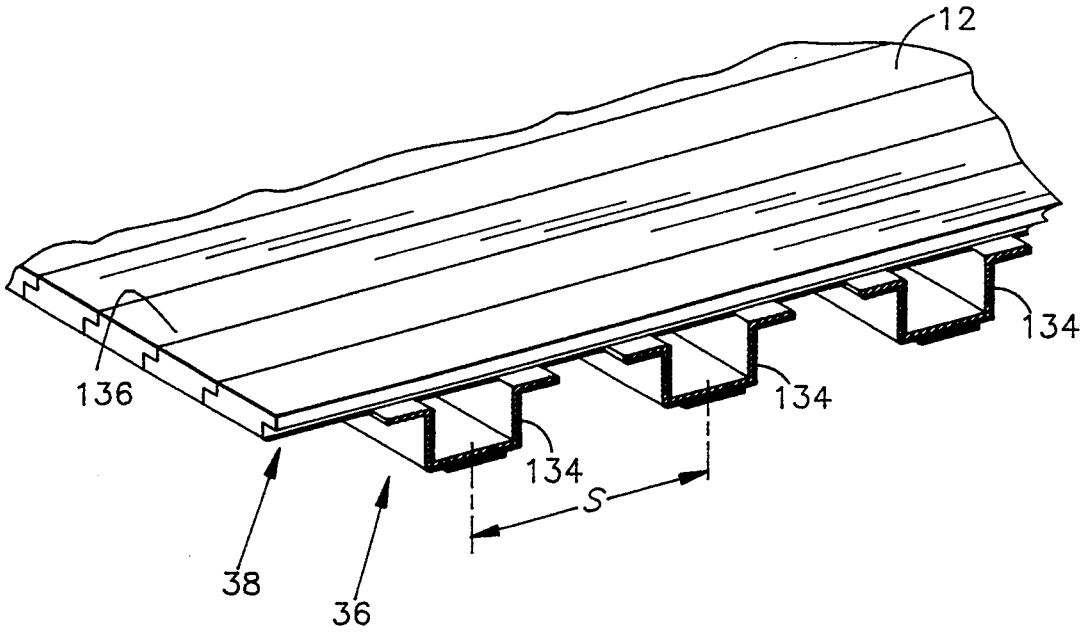
FIG. 5 is a detailed perspective view similar to FIG. 2 of an alternate floor structure of such a cargo carrier showing several U-shaped low profile floor supports.

In order to achieve a thin, low vertical height floor structure that maximizes internal volume of the cargo carrier 10, the floor 12 can alternatively be constructed as shown in FIG. 5 to comprise a first layer 36 having a plurality of spaced apart low profile floor supports 134 which extend transversely between the side walls 16. The low profile floor supports 134 are substantially uniformly distributed along the entire floor 12 at a regular spacing. Typically the floor supports 134 are spaced apart between 6 inches to 15 inches, although greater or lesser spacing can be used depending upon contemplated weight carrying capacity of the cargo carrier. In a preferred embodiment, the floor supports are spaced about 8 inches apart. The floor second layer 38 supported by the floor supports 134 is defined in part by strips 136 which can comprise $\frac{7}{8}$ inch thick interlocking hardwood strips running lengthwise of the cargo carrier 10 and perpendicular to the floor supports 134. Of course, the floor surface can be configured to be formed completely from hardwood strips, metal strips, metal plates, other conventional floor materials, or any combination of floor materials.

Figure 6:
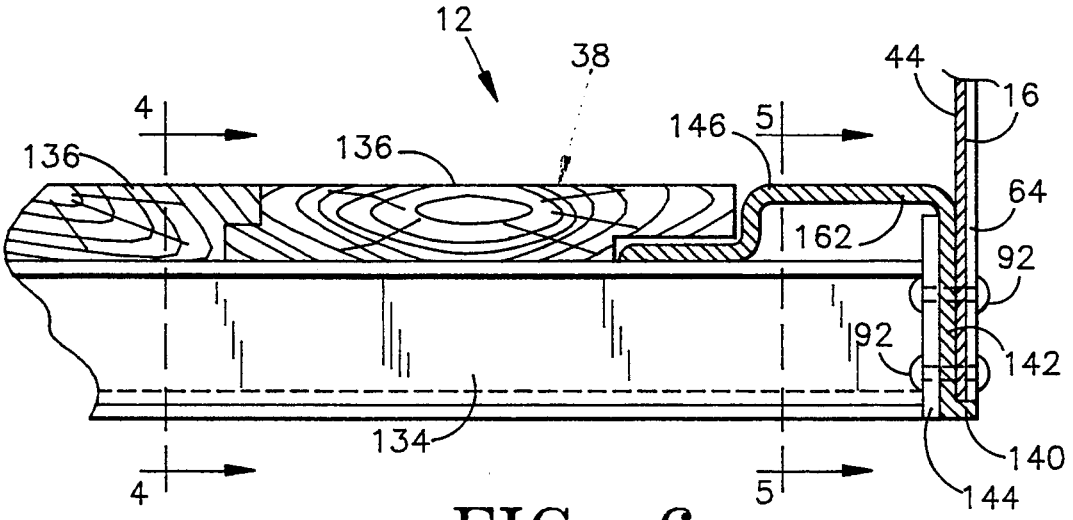
FIG. 6 is a sectional detail view of the floor structure shown in FIG. 5 and a side wall showing an alternate end structure for the low profile floor supports.

To position the floor supports 134 in fixed attachment relative to each other, each of the side walls 16 includes a longitudinally extending base rail 162 that defines the lateral outer margins of the floor surface layer 38. As shown in FIG. 6, the base rail 162 is attached to side wall 16. The base rail 162 has a lower outside flange 140 defining the lower margin of the side wall 16. A lower vertical portion 142 includes an inside surface confronting and joining end joining means 144 described in greater detail in connection with FIG. 8. An upper portion 146 of side rail 162 comprises an inwardly directed flange which defines the outer margins of the upper layer 38 of floor 12.

Figure 7:
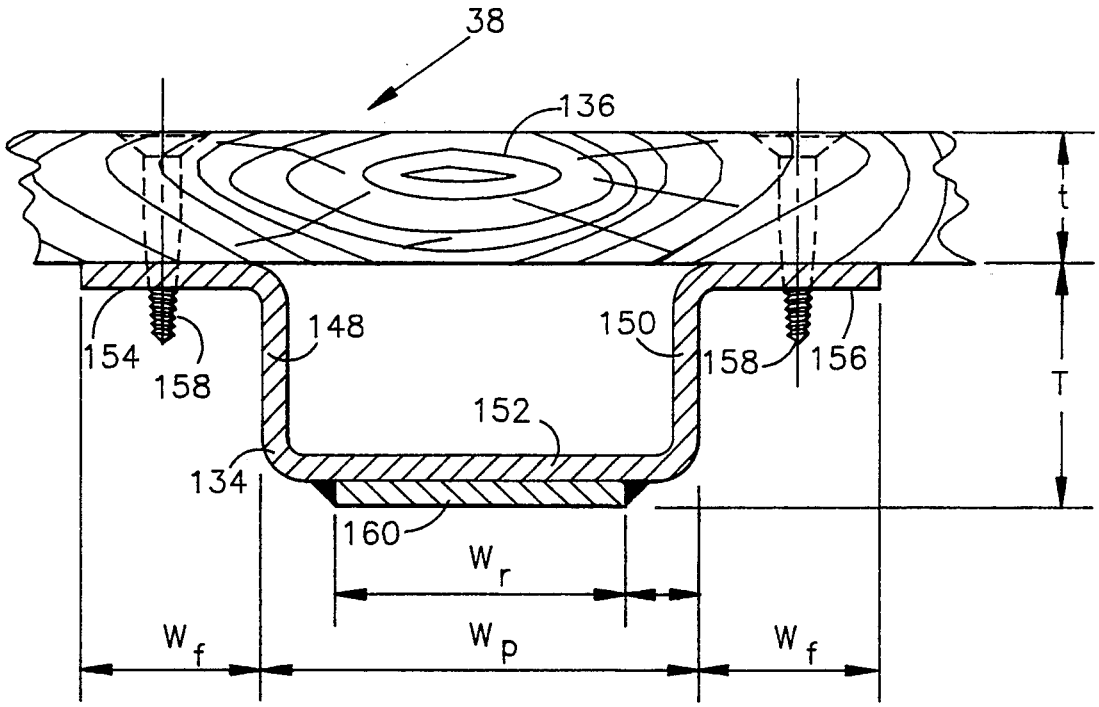
FIG. 7 is a sectional view taken along line 7—7 of FIG. 6 illustrating one embodiment of a U-shaped low profile floor support attached by threaded fasteners to a hardwood flooring strip.
Figure 8:
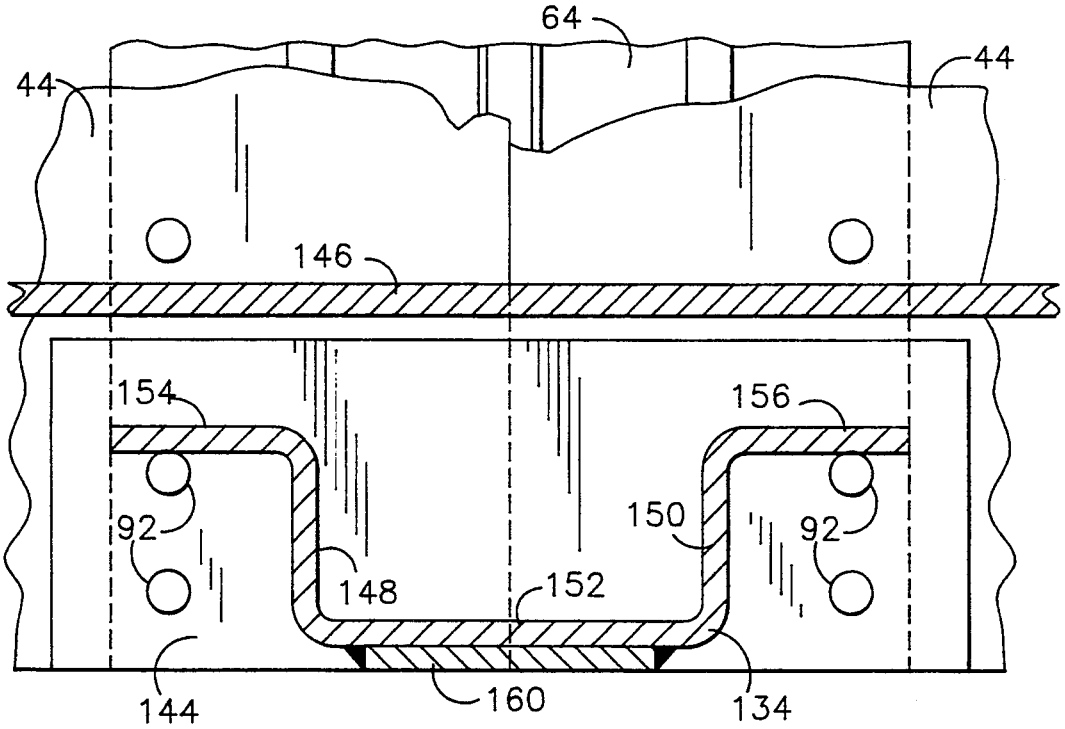
FIG. 8 is a sectional view taken along line 8—8 of FIG. 6 showing an alternate attachment of the floor support to the side wall.
Figure 9:
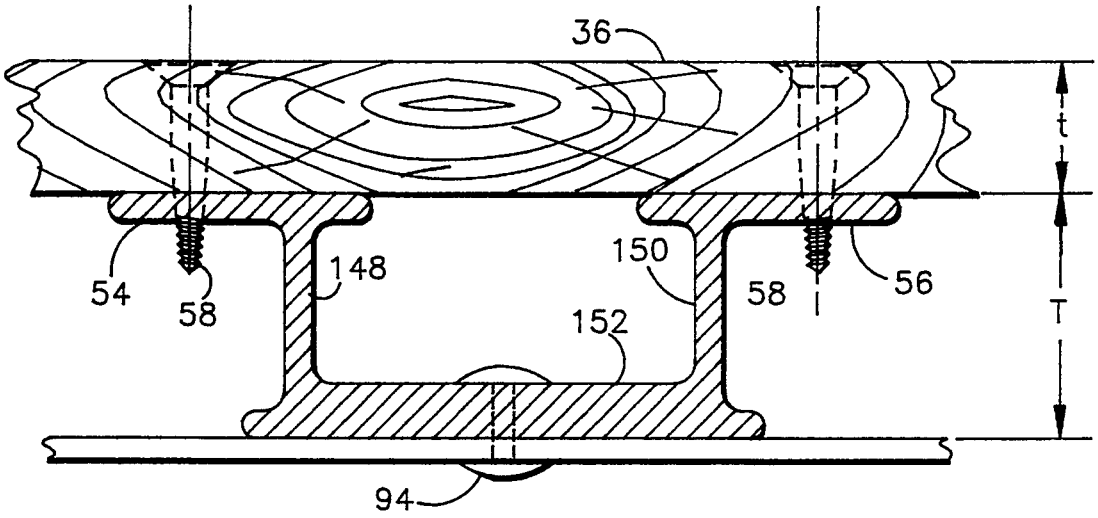
FIG. 9 is a sectional view similar to FIG. 7 illustrating another embodiment of a U-shaped low profile floor support attached by threaded fasteners to a hardwood flooring strip and attached to the side wall using a C-shaped channel as in FIG. 4.

The low profile floor supports are shown in greater detail in cross-section in FIGS. 7, 8, and 9 to comprise a pair of uniformly spaced apart vertical portions 148 and 150. A horizontal member 152 unitarily joins the vertical portions 148 and 150 to form in cross-section a very broad, shallow U-shape. Flanges 154 and 156 extend outwardly from the tops of each of the vertical elements 148 and 150, the flanges being periodically penetrated by fastening means 158 fastening the members 136 of the upper floor layer 38 to the tops of flanges 154 and 156.

In the embodiment shown in FIGS. 7 and 8, a reinforcing means 160 is welded to the horizontal portion 152 over substantially its entire length to provide a strengthening of the bottom of the U-shaped supports 134. The thickness "t" of the upper floor layer 38 is typically $\frac{7}{8}$ inch while the thickness "T" of the low profile support elements 134 are less than or equal to about $1\frac{1}{2}$ inch. The width "$W_r$" of the reinforcing portion 160 is typically about 2 inches while the distance "$W_p$" between the vertical portions 148 and 150 is approximately 3 inches. The width of the flanges "$W_f$" is preferably about $1\frac{1}{4}$ inches. The preferred material for the formation of the low profile support elements is 7 gauge (0.171 inch) high-tensile steel.

The end joining means 144 are welded to the ends of the low profile support elements 134 and are shown in FIGS. 6 and 8 to extend above the flanges 154 and 156. Each end joining means 144 is coupled to the base rail 162 by fasteners 92 which penetrate the support elements 144, the base rail 162, the aluminum alloy plates 44 collectively forming the sides 16, and the aluminum joining panel 64.

In another embodiment shown in FIG. 9, the reinforcing means 160 of U-shaped floor support 134 is not separately formed, but integrally formed as a single extruded piece, with the horizontal member 152 appropriately thickened relative to vertical portions 148 and 150 to increase its strength and rigidity. The extruded U-shaped floor support 134 can be made of high strength aluminum but is preferably made of ASTM A-588-88 grade A, 80,000 PSI minimum yield steel. The ends of the extruded floor supports 134 can include joining means 144 as previously described in connection with FIG. 8. Alternatively, the ends of the extruded floor supports can be received in the inwardly directed C-shaped channel members 32 as previously discussed in connection with FIGS. 1, 2, and 4. Additional fasteners 94 can attach the horizontal member 152 and flanges 154 and 156 to the lower and upper legs 96 and 97 of the C-shaped channel 32, respectively.

Figure 10:
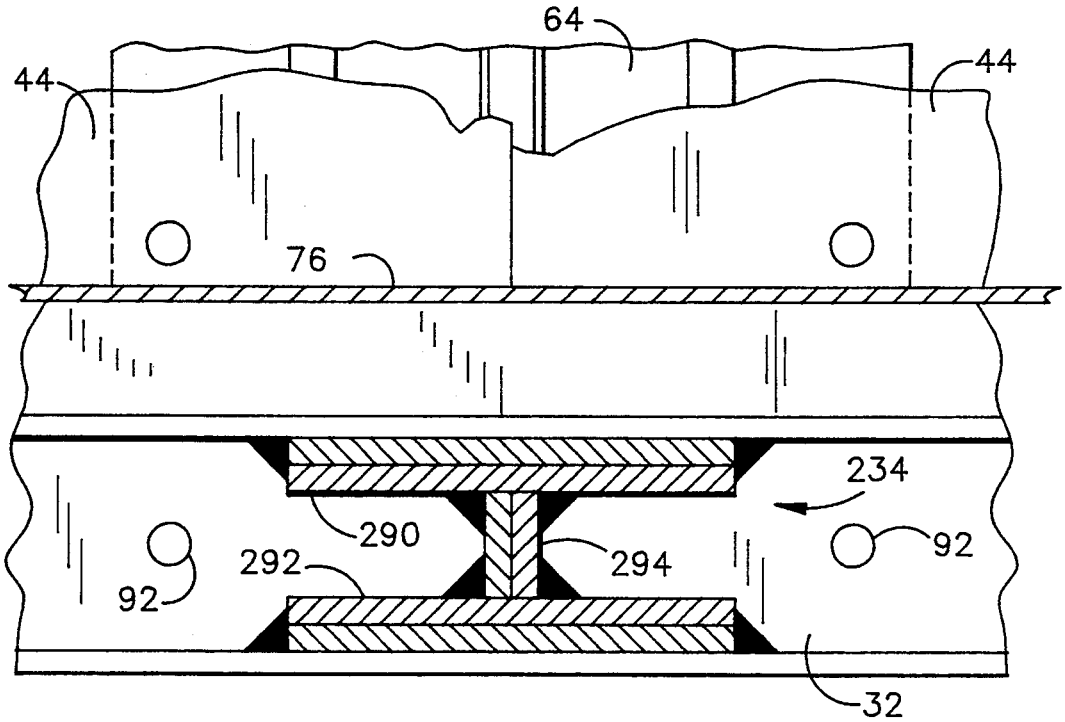
FIG. 10 is a sectional view similar to FIG. 9 illustrating a fabricated H-beam low profile floor support welded to a C-shaped channel and supporting a second layer floor as shown in FIGS. 2 and 3.

In another embodiment shown in FIG. 10, low profile floor supports in the form of fabricated steel H-beam 234 preferably comprise pairs of plates forming each leg 290 and 292, and the vertical cross-member 294. The ends of the fabricated floor supports 234 are shown to be received in and welded to the inwardly directed C-shaped channel members 32 as previously discussed in connection with FIGS. 1, 2, and 4. The ends of the fabricated floor supports 234 can alternatively include joining means 144 as previously described in connection with FIG. 8.

By utilizing a floor structure in accordance with the present invention, it is possible to achieve an interior vertical dimension at the door opening and throughout the interior of the cargo carrier of 110 inches. By using the thin side wall structure of joined aluminum plates, the interior width dimension can approach or equal 101 inches. In certain preferred embodiments, the overall length of the cargo carrier can approach 53 feet, thereby defining a substantially obstruction-free volume of exceptionally high cubic volume capacity for a cargo carrier, whether trailer or container.

Transport of cargo carriers having low profile floor supports in accordance with the present invention can be facilitated by provision of various lift attachment devices. As illustrated generally in FIG. 11, the cargo carrier 10 is provided with top lift pockets 170. The lift pockets 170 are provided in sets of four pockets. The pockets 170 are positioned bilaterally symmetrically with respect to each other, with two pockets on one side wall 16 being matched by correspondingly positioned pockets on the opposite side wall. In addition, pairs of pockets are typically positioned equivalent distances from the center of mass of the cargo carrier 10 to reduce problems with differential forces applied to lifting mechanisms hooked into the lift pockets to move the cargo carrier 10.

The top lift pocket 170 is shown in more detail in FIGS. 12 and 13. As shown in those figures, the top lift pocket 170 is formed by the combination of a back plate 176 and a guide plate 174 formed to define a guide plate aperture 172. The guide plate 174 is situated to lie in parallel contiguous relationship to the side wall 16 and in spaced apart parallel relationship to the back plate 176 to define a cavity 177 therebetween. The guide plate aperture 172 includes opposing edges 180 and 182 having upwardly converging linear segments 184 and 186 for guiding the lift element into engagement with the lift pocket 170. Each lift pocket 170 further comprises an upper edge 185 defined by an arcuate segment intersecting the upwardly converging linear segments 184 and 186 of the guide plate opposing edges 180 and 182. The back plate 176 further comprises a lower, outwardly inclined portion 188 for encouraging disengagement of the lift element from the guide plate aperture 172 upon downward movement of the lift element with respect to the cargo carrier 10.

The top lift pocket 170 is dimensioned to accommodate insertion of a lift shoe 212, connected to a lift bolt 210. The lift bolt 210 can be connected to a crane, spreader, mover or some other device capable of lifting the carrier 10. As will be appreciated by those skilled in the art, it is not necessary to use four lift pockets 170 located at the corners of the cargo carrier 110. Instead, alternate positions of lift pockets are contemplated, as well as differing numbers of lift: pockets, as needed.

Although the invention has been described in detail with reference to the illustrated preferred embodiment, variations and modifications exist within the scope and spirit of the invention as described and as defined in the following claims.

What is claimed is:

1. A cargo carrier liftable by a lift element of a vertical mover, the cargo carrier comprising a floor, a roof, a pair of parallel side walls, and first and second end walls, at least one of the side walls and end walls including a opening to permit the entry and exit of cargo, and a plurality of lift pockets fixed to said pair of parallel side walls, each lift pocket comprising a back plate positioned between the pair of sidewalls and attached to one of the sidewalls, a guide plate attached to lie in parallel contiguous relationship to the side wall in spaced apart parallel relationship to the back plate to define a cavity therebetween, the guide plate having a guide plate aperture therethrough to allow acceptance of the lift element, the guide plate aperture including opposing edges having upwardly converging linear segments for guiding the lift element into engagement with the lift pocket, the back plate further comprising a lower, outwardly inclined portion for encouraging disengagement of the lift element from the guide plate aperture upon downward movement of the lift element with respect to the cargo carrier.

2. A cargo carrier according to claim 1 wherein each lift pocket further comprises an upper edge of the guide plate aperture defined by an arcuate segment intersecting the upwardly converging linear segments of the guide plate opposing edges.

3. A cargo carrier according to claim 1 wherein said plurality of lift pockets are positioned bilaterally symmetric with respect to each other, with each lift pocket on one of the side walls being matched by a corresponding lift pocket on the other side wall.

4. A cargo carrier according to claim 1 wherein pairs of said plurality of lift pockets are attached equivalent distances from a center of mass of the cargo carrier to facilitate even lifting of the cargo container.

5. A cargo carrier according to claim 1 wherein the floor comprises a plurality of low profile floor supports extending between the side walls to increase container capacity without increasing exterior dimensions of the container.

6. A cargo carrier according to claim 5 wherein the floor further comprises a pair of spaced parallel C-shaped channel members opening toward each other, the plurality of low profile floor supports extending between the side walls having ends received in the C-shaped channel members.

7. A cargo carrier according to claim 6 wherein each of the C-shaped channel members is defined by a bight joining a pair of parallel legs, and wherein each of said side walls comprises a longitudinally extending base rail including a lower portion situated adjacent the bight of one of the C-shaped channel members, and means for joining the base rail lower portion to the bight of the adjacent C-shaped channel member.

8. A cargo carrier according to claim 5 wherein the plurality of low profile floor supports comprises a plurality of panels situated contiguously to each other in a common plane, each panel comprising a unitary member including a pattern of webs and flanges defining parallel ducts and channels.

9. A cargo carrier according to claim 5 wherein the floor further comprises a second layer situated immediately above the common plane of said plurality of low profile floor supports, the second layer comprising a plurality of elements fixed to the plurality of low profile floor supports, the plurality of elements extending longitudinally parallel to the C-shaped channel members.

10. A cargo carrier according to claim 9 wherein the plurality of longitudinally extending elements comprise wood flooring strips.

11. A cargo carrier according to claim 9 wherein the plurality of longitudinally extending elements comprise extruded aluminum members.

12. A cargo carrier according to claim 5 wherein said plurality of low profile floor supports each further comprise means extending along edges thereof for interlocking contiguous low profile floor supports together.

13. A cargo carrier according to claim 5 wherein said plurality of low profile floor supports each further comprise a pair of spaced apart vertical members having upper and lower ends, and a horizontal member connected to join the lower ends of the vertical members to form in cross section a U-shape, with vertical length of the vertical members being less than horizontal spacing between the vertical members of each floor support.

14. A cargo carrier according to claim 13 further comprising an outwardly extending flange attached to an upper end of each vertical member of each low profile floor support.

15. A cargo carrier according to claim 13 further comprising reinforcing means for reinforcing the horizontal member of each low profile floor support to increase rigidity of the floor support.

16. A cargo carrier according to claim 15 wherein said reinforcing means is unitary with the horizontal member.

17. A cargo carrier liftable by a lift element of a vertical mover, the cargo carrier comprising a floor, a roof, a pair of parallel side walls, and first and second end walls, at least one of the side walls and end walls including a opening to permit the entry and exit of cargo, a plurality of low profile floor supports extending between the side walls to increase container capacity without increasing exterior dimensions of the container, and a plurality of lift pockets fixed to said pair of parallel side walls adjacent the roof, each lift pocket comprising a back plate positioned between the pair of sidewalls and attached to one of the sidewalls, a guide plate attached to lie in parallel contiguous relationship to the side wall in spaced apart parallel relationship to the back plate to define a cavity therebetween, the guide plate having a guide plate aperture therethrough to allow acceptance of the lift element, the guide plate aperture including opposing edges having upwardly converging linear segments for guiding the lift element into engagement with the lift pocket, and an upper edge of the guide plate aperture defined by an arcuate segment intersecting the upwardly converging linear segments, the back plate further comprising a lower, outwardly inclined portion for encouraging disengagement of the lift element from the guide plate aperture upon downward movement of the lift element with respect to the cargo carrier.

18. A cargo carrier according to claim 17 wherein four of said lift pockets are positioned bilaterally symmetric with respect to each other, with two lift pockets on one of the side walls being matched by two corresponding lift pockets on the other side wall.

19. A cargo carrier according to claim 17 wherein the floor further comprises a second layer situated immediately above the common plane of said plurality of low profile floor supports, the second layer comprising a plurality of elements fixed to the plurality of low profile floor supports, the plurality of elements extending longitudinally parallel to the side walls of the cargo carrier.

20. A cargo carrier according to claim 17 further comprising a running gear including a pair of beams fixed to a bottom surface of said plurality of panels parallel to the U-shaped channel members and a wheel assembly including means for adjusting the position of the wheel assembly relative to the pair of beams.

* * * * *